US006463639B1

(12) United States Patent
Mori

(10) Patent No.: US 6,463,639 B1
(45) Date of Patent: Oct. 15, 2002

(54) BUCKLE

(75) Inventor: Shinji Mori, Aichi-ken (JP)

(73) Assignee: Kabushiki Kaisha Tokai-Rika-Denki-Siesakusho, Aichi-ken (JP)

( * ) Notice: Subject to any disclaimer, the term of this patent is extended or adjusted under 35 U.S.C. 154(b) by 0 days.

(21) Appl. No.: 09/719,371

(22) PCT Filed: Jun. 23, 1999

(86) PCT No.: PCT/JP99/03331

§ 371 (c)(1),
(2), (4) Date: Dec. 11, 2000

(87) PCT Pub. No.: WO99/66813

PCT Pub. Date: Dec. 29, 1999

(30) Foreign Application Priority Data

Jun. 23, 1998 (JP) ..... 10-176339
Nov. 2, 1998 (JP) ..... 10-312505

(51) Int. Cl.[7] ..... A44B 11/26

(52) U.S. Cl. ..... 24/633; 24/629; 24/636; 24/642

(58) Field of Search ..... 24/611, 613, 625, 24/629, 633, 641, 642, 636

(56) References Cited

U.S. PATENT DOCUMENTS 4,197,619 A * 4/1980 Burleigh ..... 24/642
4,428,103 A * 1/1984 Wier ..... 24/654
4,622,727 A * 11/1986 Wier ..... 24/641
5,067,212 A * 11/1991 Ellis ..... 24/633
5,596,795 A * 1/1997 Beisswenger ..... 24/633
5,699,594 A * 12/1997 Czank et al. ..... 24/632

FOREIGN PATENT DOCUMENTS

| | | |
|---|---|---|
| JP | 55-42699 | 3/1980 |
| JP | 63-45203 | 9/1988 |
| JP | 2-41962 | 9/1990 |
| JP | 8-47408 | 2/1996 |

* cited by examiner

*Primary Examiner*—Robert J. Sandy
*Assistant Examiner*—Andre' Jackson
(74) *Attorney, Agent, or Firm*—Nixon Peabody LLP; Thomas W. Cole

(57) ABSTRACT

A buckle that can be manufactured at lower cost and is not unlocked even when a tongue plate is pushed in a locked state is obtained.

An intermediate arm 60 is fixed to a lock spring 54 attached to a button 28. Facing walls 68 of leg portions 66 of the intermediate arm 60 face distal ends of horn pieces 26 of an ejector 22. In the locked state, a predetermined clearance 72 is formed between the facing walls 68 and protrusions 70 of the horn pieces 26. Accordingly, even if a tongue plate 20 is moved further in the direction of the arrow A, the facing walls 68 are not moved in the direction of the arrow A. The button 28 is not moved in an unlocking direction (the direction of the arrow A), either, and movement of a latch 48 in a disengaging direction (the direction opposite to the arrow B) is certainly prevented. As protrusions 38 can be formed in a small size, a buckle 10 is formed in a small size, and the buckle 10 can be manufactured at lower cost.

6 Claims, 15 Drawing Sheets

BUCKLE

TECHNICAL FIELD

The present invention relates to a buckle, more specifically, for example, to a buckle for maintaining a webbing in a fastened state by engaging with a tongue plate which is provided at the webbing of a vehicular seat belt device.

BACKGROUND ART

FIG. 15 shows an example of a conventional buckle (see Japanese Patent Application Publication (JP-B) No. 63-45203).

In this buckle 200, when a tongue plate 202 is inserted into an insertion portion 204 and an ejector (not shown) is moved, a button 206 is pushed by the ejector and is slid. Therefore, a protrusion 208 formed at the button 206 is separated from a latch 210, and the latch 210 can move in a direction of engaging with an engagement hole 212 of the tongue plate 202 (the direction of the arrow G). In an engaged state, the protrusion 208 of the button 206 abuts against the latch 210 so as to prevent the latch 210 from moving in a disengaging direction (the direction opposite to the arrow G). Accordingly, removal of the tongue plate 202 is prevented (i.e., a locked state), and an unillustrated webbing of a seat belt device is maintained in a state for fastening a fastener.

When the button 206 is pushed and slid in an unlocking direction (the direction of the arrow F), the protrusion 208 is separated from the latch 210, and the latch 210 can move in the disengaging direction (the direction opposite to the arrow G).

In this type of buckle 200, in the locked state, the tongue plate 202 is in contact with the button 206 via the ejector without clearance. Accordingly, when the tongue plate 202 is pushed in the direction of the arrow F in the locked state, the button 206 is also moved in the unlocking direction via the ejector. Therefore, in order to prevent inadvertent unlocking even in such case, the protrusion 208 is formed in a sufficiently large size in consideration of a moving stroke of the button 206.

However, if the protrusion 208 is formed in a large size in this manner, the moving stroke of the button 206 at the time of unlocking is also increased in size. As a result, the entire buckle 200 is formed in a large size, and thus manufacturing cost is increased.

DISCLOSURE OF THE INVENTION

In consideration of such circumstances, it is an object of the present invention to obtain a buckle that can be manufactured at lower cost and is not unlocked even when a tongue plate is pushed in a locked state.

The invention is characterized by comprising: an engaging member, which can engage with a tongue plate inserted into an insertion portion up to a predetermined position; an operating member, which maintains the engaging member in an engaged state with respect to the tongue plate, and which moves the engaging member in a disengaging direction from the tongue plate by a predetermined operation; and an intermediate member, which forms at least one clearance between the intermediate member and a portion from the tongue plate to the operating member in the engaged state of the engaging member.

When the tongue plate is inserted into the insertion portion of the buckle up to the predetermined position, the engaging member engages with the tongue plate. Since the operating member maintains the engaging member in the engaged state, the tongue plate is locked and is thereby not removed inadvertently.

In the state in which the engaging member engages with the tongue plate, the intermediate member forms the clearance between the intermediate member and the portion from the tongue plate to the operating member. Accordingly, the operating member is free with respect to the tongue plate, and thus, even if the tongue plate is moved, the operating member is not moved as long as this clearance is not eliminated. Therefore, there is no need to form a member for preventing removal (e.g., protrusions or the like) in a large size to account for cases in which the operating member is moved and the tongue plate is thereby removed inadvertently when the tongue plate is pushed. As a result, the moving stroke of the operating member during disengagement of the engaging member can be reduced in size, and the entire buckle can be formed in a small size, and thus, the manufacturing cost of the buckle can be decreased.

The invention described in claim 2 is characterized in that, in the invention described in claim 1, the intermediate member is a swinging member, which is swingably attached to a supporting plate supporting the engaging member and the operating member or to the operating member, and which is pushed by the tongue plate so as to swing while the tongue plate is inserted into the insertion portion, and which forms the clearance in the engaged state of the engaging member with respect to the tongue plate.

Therefore, when the tongue plate is inserted into the insertion portion, the swinging member is pushed by the tongue plate so as to swing, and the clearance is formed between the swinging member and the portion from the tongue plate to the operating member in the state in which the engaging member engages with the tongue plate. In this way, due to a simple structure merely provided with the swinging member, the clearance can be formed between the swinging member and the portion from the tongue plate to the operating member, and thus, the manufacturing cost can be decreased.

The invention described in claim 3 is characterized in that, in the invention described in claim 2, the buckle includes an urging means which urges the engaging member to the engaged state, and the swinging member is formed integrally with the urging means.

Since the engaging member is urged to the engaged state by the urging means, the engaged state can be maintained more certainly.

Further, in the buckle provided with the urging means in advance, since the swinging member is formed integrally with the urging means, the number of parts is not increased, and the manufacturing cost is not increased.

The invention is also characterized in that the intermediate member is a moving member, which is provided at the operating member, and which moves the operating member by insertion of the tongue plate into the insertion portion and moves in a direction intersecting this moving direction orthogonally so as to form the clearance.

Therefore, when the tongue plate is inserted into the insertion portion, the moving member moves the operating member. Further, by the movement of the operating member, the moving member moves in the direction intersecting this movement orthogonally so as to form the clearance between the moving member and the portion from the tongue plate to the operating member. In this way, due to a simple structure merely provided with the moving member, the clearance can be formed between the moving member and the portion from the tongue plate to the operating member, and thus, the manufacturing cost can be decreased.

The invention is further characterized in that the swinging member is attached to the operating member, and includes a weighting body which moves inertially by an inertial force of a predetermined value or more in an unlocking direction applied to the operating member, and an engaging portion which engages with an engaged portion and prevents the swinging member from moving in the unlocking direction when the swinging member swings by an inertial movement of the weighting body.

In other words, for example, when a vehicle is in a state of rapid acceleration or rapid deceleration or the like, if inertial force of the predetermined value or more operates in the unlocking direction of the operating member (the direction for moving the engaging member in the disengaging direction from the tongue plate), the operating member tends to move in this direction. However, at that time, the weighting body moves inertially by receiving the inertial force and swings the swinging member. Due to this swing, the engaging portion engages with the engaged portion so as to prevent the swinging member from moving in the unlocking direction. Since the swinging member is attached to the operating member, the operating member is also prevented from moving in the unlocking direction. Accordingly, the engaging member is prevented from moving inadvertently from the tongue plate in the disengaging direction and is maintained in the locked state.

While the portion at which the engaged portion is provided is not limited particularly, the engaged portion can be formed at, for example, the cover or the like structuring the buckle. Accordingly, the number of parts can be prevented from increasing, and the manufacturing cost of the buckle can be decreased.

The invention is also characterized in that the buckle further comprises a moving member which moves on the basis of a movement of the tongue plate, and the intermediate member forms a predetermined clearance between the intermediate member and one of the moving member or the engaging member in the engaged state of the engaging member.

BEST MODES FOR IMPLEMENTING THE INVENTION

Figure 1:
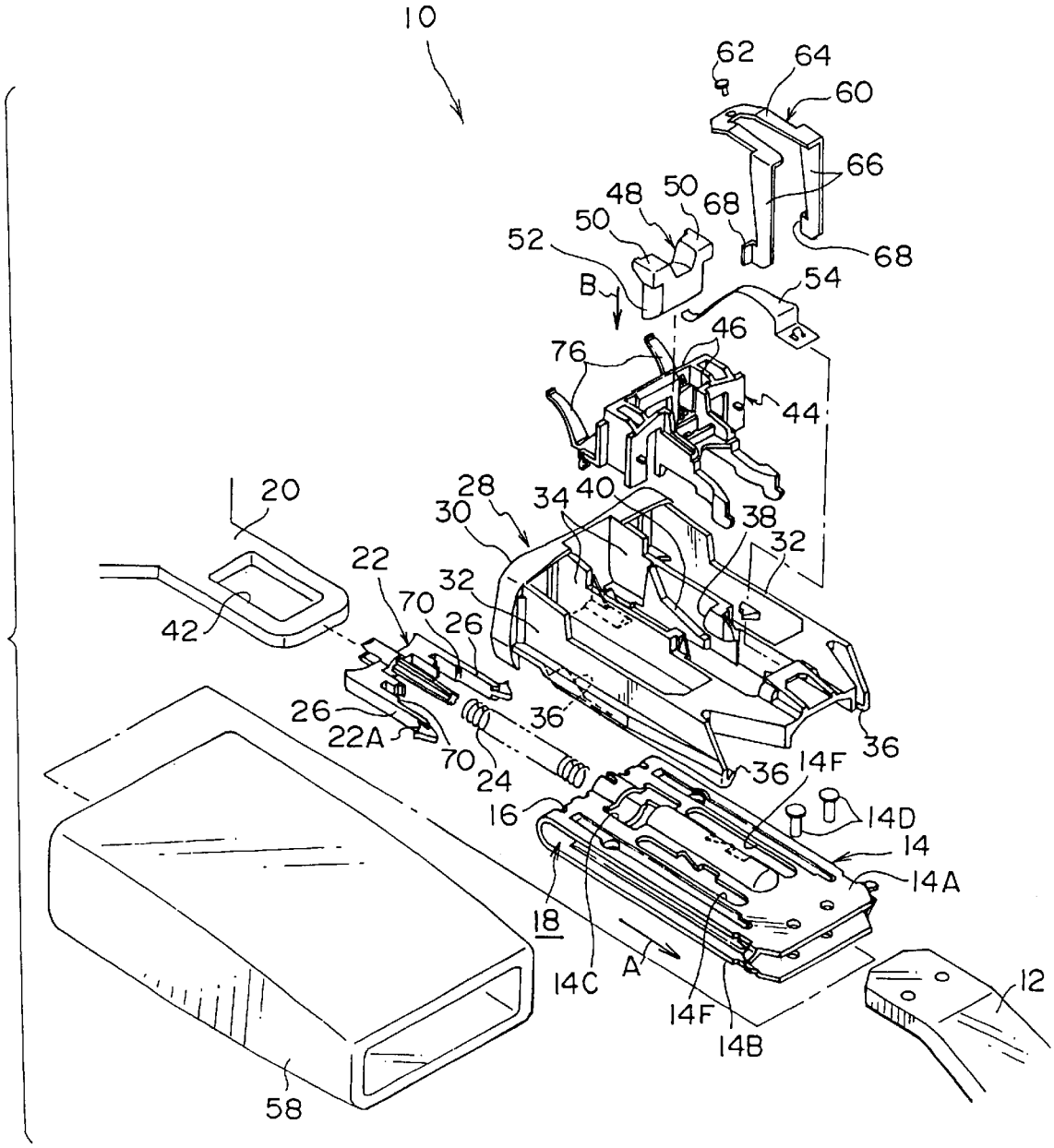
FIG. 1 is an exploded perspective view showing a buckle according to a first embodiment of the present invention.
Figure 2:
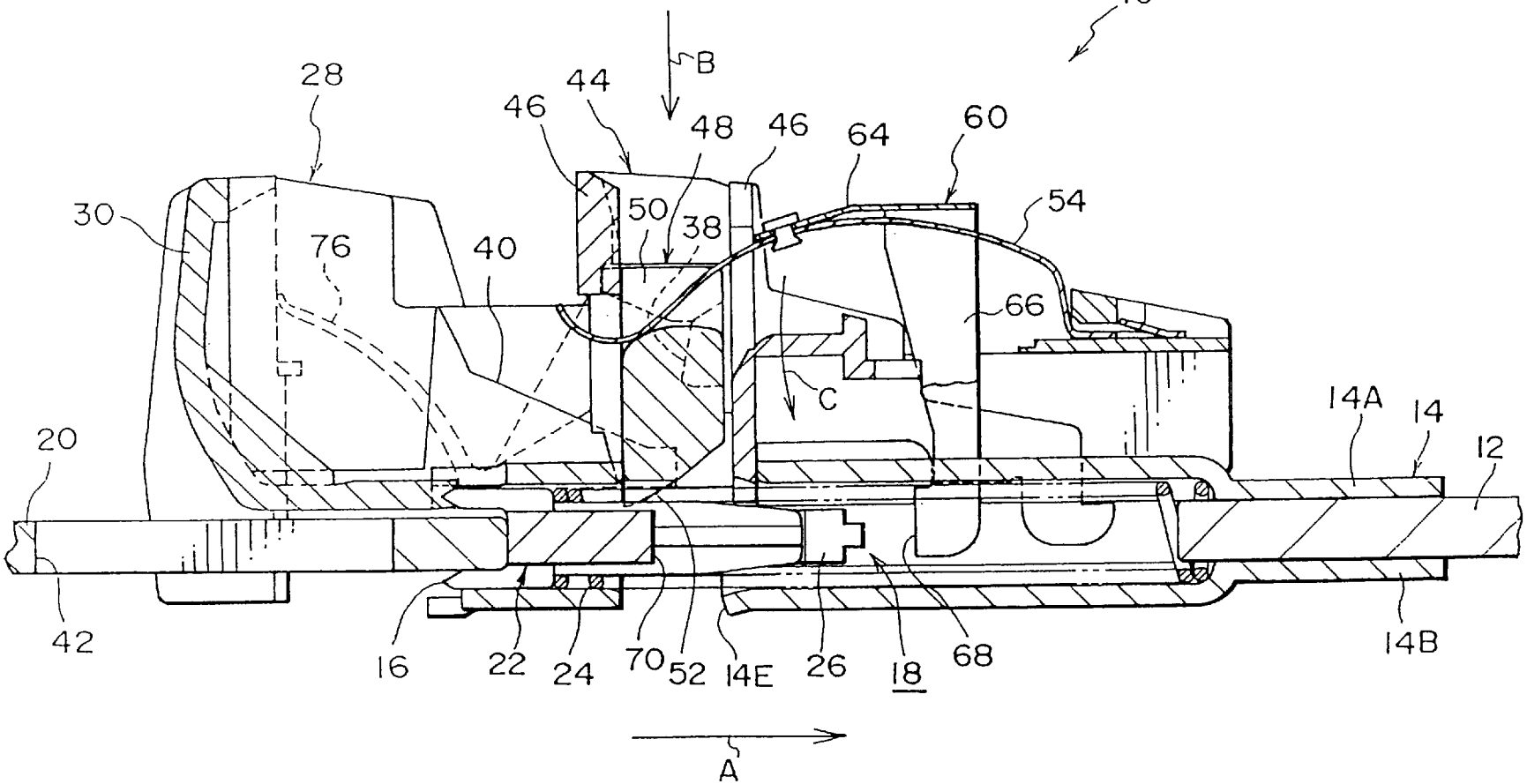
FIG. 2 is a cross-sectional view showing the buckle according to the first embodiment of the present invention.
Figure 3:
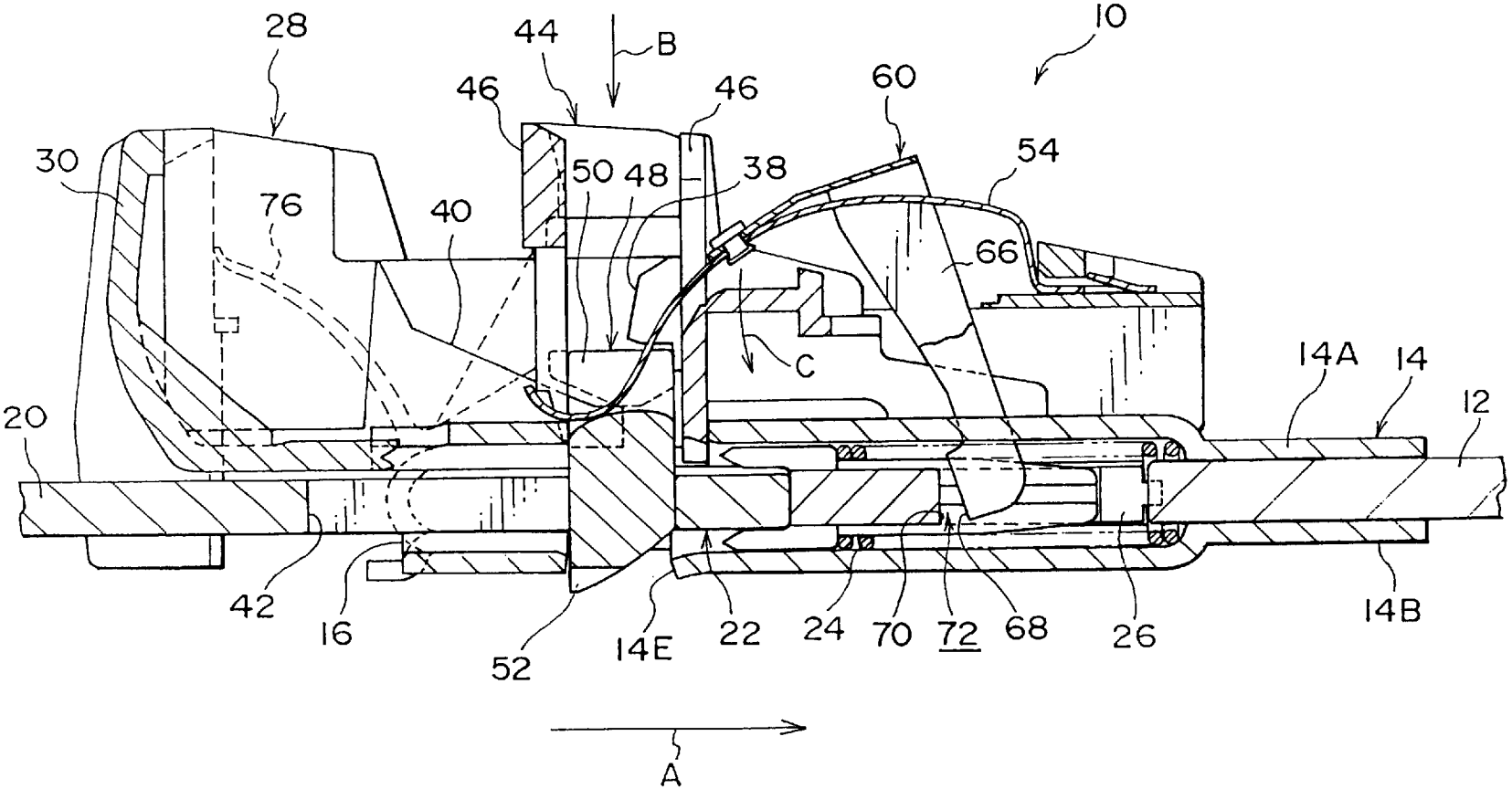
FIG. 3 is a cross-sectional view showing a locked state of the buckle according to the first embodiment of the present invention.

FIGS. 1 to 3 show a buckle 10 according to a first embodiment of the present invention. The buckle 10 has an anchor plate 14 which is attached by rivets 14D to an attachment piece 12 extended from a vehicle (not shown). The anchor plate 14 is formed by bending an elongated plate member at the longitudinal directional center thereof, and two parallel plates (an upper plate 14A and a lower plate 14B) are thereby structured at a predetermined interval. An insertion hole 16 is formed at the center of one end (a bent portion) of the anchor plate 14, and a tongue plate 20 is inserted from this insertion hole 16 into an insertion portion 18 which is structured between the upper plate 14A and the lower plate 14B. An insert-through hole (not shown) is formed at the tongue plate 20, and a webbing of a seat belt device is inserted through this insert-through hole. Further, the attachment piece 12 is inserted from the other end side of the anchor plate 14 and is fixed thereto.

An ejector 22 is accommodated within the anchor plate 14 so that the ejector 22 can slide in the longitudinal directions of the anchor plate 14 (the direction of the arrow A and the opposite direction thereto). An eject spring 24 is disposed between the ejector 22 and the attachment piece 12 so as to urge the ejector 22 toward the insertion hole 16 (in the direction opposite to the arrow A).

A pair of horn pieces 26 extending toward the attachment piece 12 are provided so as to protrude from transverse directional ends of the ejector 22. Protrusions 70 are formed at predetermined positions so that, when the ejector 22 is pushed by the tongue plate 20 and is moved toward the attachment piece 12, the protrusions 70 formed substantially at the longitudinal directional centers of the horn pieces 26 press protrusions (not shown) provided protrudingly at a button 28. Further, the ejector 22 can move until abutting portions 22A formed near top ends of the horn pieces 26 have abutted against protrusions (not shown) protruded from the anchor plate 14 into the insertion portion 18, and thus the movement of the ejector 22 is restricted within a fixed range.

The button 28 is attached to the upper plate 14A side of the anchor plate 14. The button 28 is formed in a substantially rectangular frame-shape in a plan view, and has a pressing plate 30 for a pressing operation, a pair of parallel outer plates 32 which protrude from the vicinities of the transverse directional ends of this pressing plate 30, and a pair of parallel inner plates 34 which protrude from the transverse directional inner side with respect to the outer plates 32.

Pawl pieces 36 toward the inner side are formed at the outer plates 32. These pawl pieces 36 engage with portions between the upper plate 14A and the lower plate 14B of the anchor plate 14 from the outer sides of the anchor plate 14, so that the button 28 cannot be released from the anchor plate 14 and can slide in the longitudinal directions of the anchor plate 14 (the direction of the arrow A and the opposite direction thereto).

Protrusions 38 are protrudingly provided on the inner surfaces of the inner plates 34. Further, release surfaces 40, which are inclined in a direction of gradually separating from the anchor plate 14 as the pressing plate 30 is approached, are formed at the pressing plate 30 side with respect to the protrusions 38. As shown in FIG. 2, in the state in which the tongue plate 20 is not inserted into the insertion portion 18, the protrusions 38 abut against lower surfaces of abutment pieces 50 of a latch 48, which will be described later, so as to prevent the latch 48 from moving in an engaging direction (the direction of the arrow B). Further, as shown in FIG. 3, in the state in which the tongue plate 20 is inserted into the insertion portion 18 and the latch 48 engages with an engagement hole 42 of the tongue plate 20 (a locked state), the protrusions 38 abut against upper surfaces of the abutment pieces 50 of the latch 48 so as to prevent the latch 48 from moving in a disengaging direction (the direction opposite to the arrow B).

When the button 28 is moved in an unlocking direction (the direction of the arrow A) by pressing force in the locked state, the release surfaces 40 convert this pressing force to force which moves the latch 48 in the disengaging direction (the direction opposite to the arrow B), and push the abutment pieces 50 from the lower surfaces side thereof. Accordingly, the latch 48 is moved in the disengaging direction.

On the upper plate 14A, holding block 44 straddling the inner plates 34 are disposed upright at positions which are more inward than the outer plates 32 of the button 28. The holding block 44 has a pair of parallel holding plates 46, and the latch 48 is disposed between these holding plates 46. The holding plates 46 prevent the latch 48 from moving in the longitudinal directions of the anchor plate 14 (the direction of the arrow A and the opposite direction thereto), and allow the latch 48 to move in the engaging and disengaging directions (the direction of the arrow B and the opposite direction thereto).

The latch 48 is formed in a substantially U-shaped form in a front view, and the abutment pieces 50 extend from the upper ends thereof toward the transverse directional outer sides. Further, an engagement piece 52 extends from the transverse directional center of the latch 48 toward the tongue plate 20. When the tongue plate 20 is inserted into the insertion portion 18 up to a predetermined position, the engagement piece 52 passes through a pass-through hole 14C formed through the upper plate 14A of the anchor plate 14, engages with the engagement hole 42 of the tongue plate 20, and further passes through a pass-through hole 14E (see FIG. 2) formed through the lower plate 14B.

A pair of plate spring pieces 76 are provided so as to protrude from the holding block 44 toward the pressing plate 30 of the button 28, and urge the button 28 in the direction opposite to the arrow A. Accordingly, when the pressing plate 30 is pressed, appropriate resistance is generated.

One end of a plate spring-shaped lock spring 54 is attached to the button 28. The other end of the lock spring 54 abuts against the upper surface of the latch 48 and urges the latch 48 in the engaging direction (the direction of the arrow B).

An intermediate arm 60 is fixed by a rivet 62 substantially at the longitudinal directional center of the lock spring 54. The intermediate arm 60 consists of a U-shaped portion 64 which is in a substantially U-shaped form in a plan view, and a pair of leg portions 66 which extend from the ends of this U-shaped portion 64 toward the anchor plate 14.

The leg portions 66 pass through a pair of elongated holes 14F which are formed along the longitudinal direction of the anchor plate 14, and distal ends thereof extend into the insertion portion 18. Further, at the distal ends of the leg portions 66, facing walls 68 are formed by bending the plate members structuring the leg portions 66 substantially at right angles, and these facing walls 68 face distal ends of the protrusions 70 of the horn pieces 26 of the ejector 22. Therefore, when the tongue plate 20 is inserted into the insertion portion 18 and the ejector 22 is thereby slid in the direction of the arrow A against urging force of the eject spring 24, the facing walls 68 are pressed by the protrusions 70 and are moved in the direction of the arrow A.

The intermediate arm 60 and the lock spring 54 have predetermined elasticity. When the facing walls 68 are moved in the direction of the arrow A, the intermediate arm 60 and the lock spring 54 move the button 28 in the direction of the arrow A while swinging slightly in the counterclockwise direction (the direction of the arrow C) with one end of the lock spring 54 (the portion fixed to the button 28) as the center. Accordingly, the protrusions 38 of the button 28 are separated from the abutment pieces 50 of the latch 48, and thus, the latch 48 is moved in the engaging direction (the direction of the arrow B) by urging force of the lock spring 54.

Further, the shapes of the lock spring 54 and the intermediate arm 60 are determined so that a predetermined clearances 72 are formed between the facing walls 68 and the protrusions 70 in the state in which the latch 48 is moved in the engaging direction (the direction of the arrow B) and the engagement piece 52 engages with the engagement hole 42 (the locked state), as shown in FIG. 3.

A buckle body 56 is structured by the anchor plate 14, the ejector 22, the button 28, the eject spring 24, the holding block 44, the latch 48, the lock spring 54 and the intermediate arm 60, which are described above.

A cover 58 is attached to this buckle body 56, and the anchor plate 14, the ejector 22, the button 28, the eject spring 24, the holding block 44, the latch 48, the lock spring 54 and the intermediate arm 60 are covered. The cover 58 is formed in a substantially rectangular tube-shape with the longitudinal directional ends thereof being open. The cover 58 is slid from the other end side of the attachment piece 12 so as to accommodate the attachment piece 12 inside thereof. Then, a fixing protrusion (not shown) of the anchor plate 14 engages with the cover 58 at a position in which the buckle body 56 is covered, and thus the cover 58 does not become removed from the buckle body 56.

Next, operation of the buckle 10 according to the first embodiment will be described.

As shown in FIG. 2, in the state in which the tongue plate 20 is not inserted into the insertion portion 18, the protrusions 38 of the button 28 abut against the abutment pieces 50 of the latch 48 from the lower side thereof, and thus, the latch 48 does not move in the engaging direction (the direction of the arrow B) by the urging force of the lock spring 54.

When the tongue plate 20 is inserted into the insertion portion 18 and the ejector 22 is slid in the direction of the arrow A against the urging force of the eject spring 24, the protrusions 70 of the ejector 22 press the facing walls 68 of the intermediate arm 60, and thus the facing walls 68 move in the direction of the arrow A. Further, the lock spring 54 and the intermediate arm 60 move the button 28 in the direction of the arrow A while swinging slightly in the counterclockwise direction (the direction of the arrow C) with one end of the lock spring 54 (the portion fixed to the button 28) as the center. Accordingly, the protrusions 38 of the button 28 are separated from the abutment pieces 50 of the latch 48, and thus, the latch 48 is moved in the engaging direction (the direction of the arrow B) by receiving the urging force of the lock spring 54. As a result, as shown in FIG. 3, the engagement piece 52 of the latch 48 passes through the pass-through hole 14C of the upper plate 14A, and engages with the engagement hole 42 of the tongue plate 20. The button 28 is pushed by the plate spring pieces 76 and is moved in the direction opposite to the arrow A so as to be in the locked state.

In the locked state, the protrusions 38 of the button 28 abut against the abutment pieces 50 of the latch 48 from the upper side thereof so as to prevent the latch 48 from moving in the disengaging direction (the direction opposite to the arrow B).

Further, in the locked state, the distal end of the lock spring 54 presses the latch 48 and moves downward. Therefore, the lock spring 54 and the intermediate arm 60 swing in the counterclockwise direction (the direction of the arrow C) by the elasticity of the lock spring 54, and the predetermined clearances 72 are formed between the facing walls 68 and the protrusions 70 of the horn pieces 26. Accordingly, even when the tongue plate 20 is moved further in the direction of the arrow A in the locked state, if the amount of the movement of the tongue plate 20 is within this clearance 72, the facing walls 68 are not moved in the direction of the arrow A. Further, when the amount of the movement of the tongue plate 20 has reached the predetermined amount, the ejector 22 abuts against the attachment piece 12 and this movement is thereby restricted. Accordingly, the button 28 is not moved in the unlocking direction (the direction of the arrow A), either, and the protrusions 38 of the button 28 are not separated from the abutment pieces 50 of the latch 48. As a result, the movement of the latch 48 in the disengaging direction (the direction opposite to the arrow B) is certainly prevented.

In order to release the locked state so as to separate the tongue plate 20 from the buckle 10, the pressing plate 30 of the button 28 is pressed and the button 28 is slid in the unlocking direction (the direction of the arrow A). The protrusions 38 of the button 28 are thereby separated from the abutment pieces 50 of the latch 48, so that the latch 48 can move in the disengaging direction (the direction opposite to the arrow B). When the button 28 is slid further, the release surfaces 40 of the button 28 push the abutment pieces 50 of the latch 48 in the disengaging direction (the direction opposite to the arrow B), and thus, the latch 48 is moved in the disengaging direction and the engagement piece 52 is removed from the engagement hole 42 of the tongue plate 20. As a result, the tongue plate 20 is removed in the direction opposite to the arrow A by the urging force of the eject spring 24 which is applied via the ejector 22.

In this way, in the buckle 10 according to the first embodiment, in the locked state, the clearance 72 is formed between the intermediate arm 60 and a portion from the tongue plate 20 to the button 28, so that the button 28 is not moved in the unlocking direction even if the tongue plate 20 is moved, and thus, there is no need to form the protrusions 38 in a large size in order to prevent unlocking even when the tongue plate 20 is moved. This facilitates formation of the button 28. Further, as the protrusions 38 are smaller compared with conventional ones, only a small moving stroke of the button 28 is needed for unlocking. This improves the feeling during operation at the time of unlocking. Moreover, as the entire buckle 10 can also be formed in a small size, the buckle 10 can be manufactured at lower cost.

In the above descriptions, a structure in which the lock spring 54 and the intermediate arm 60 are formed as separated bodies and these are fixed each other by a rivet 62 is used as an example. However, the lock spring 54 and the intermediate arm 60 may be formed integrally. By integrating, the number of parts is reduced further, and the buckle 10 can be manufactured at lower cost.

Figure 4:
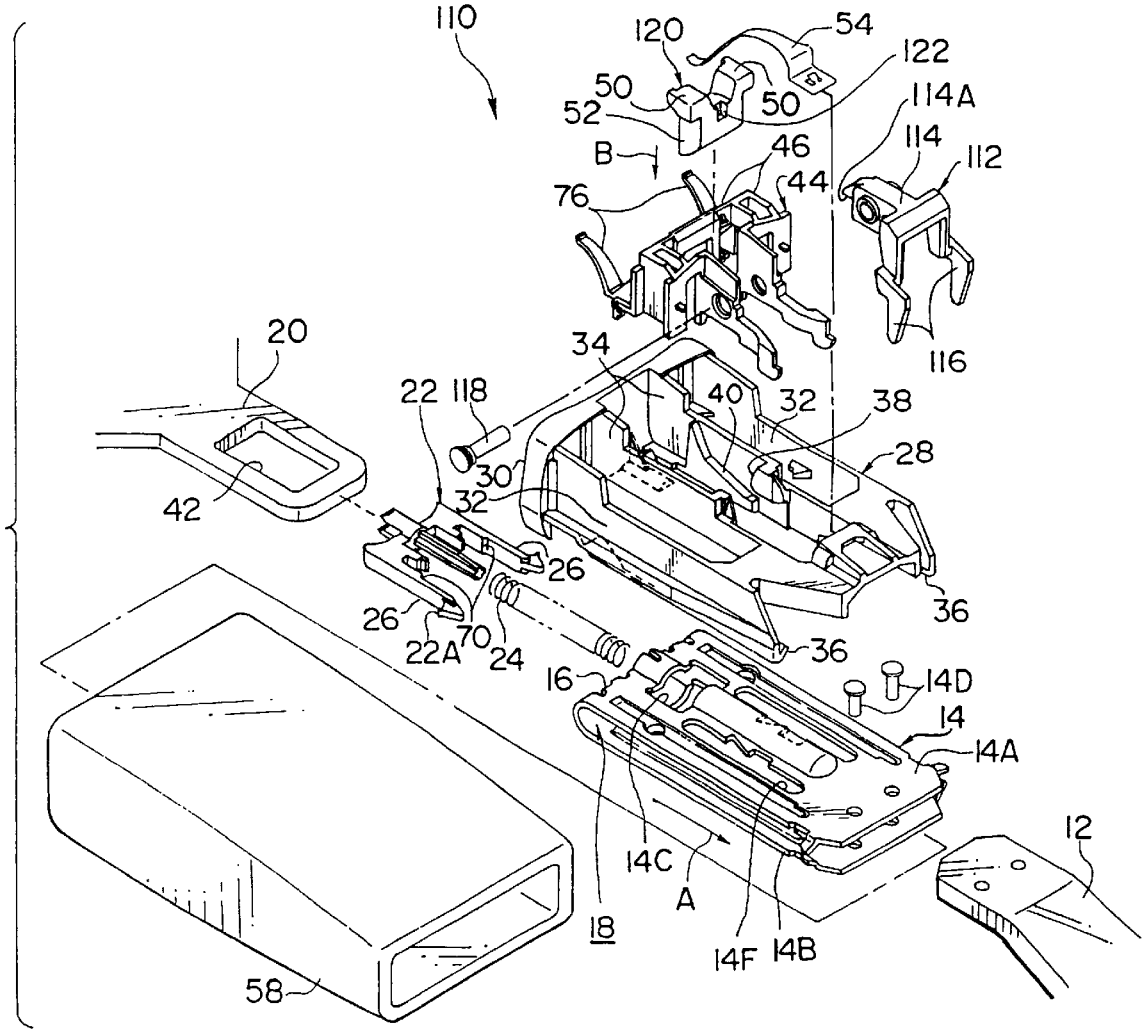
FIG. 4 is an exploded perspective view showing the buckle according to a second embodiment of the present invention.
Figure 5:
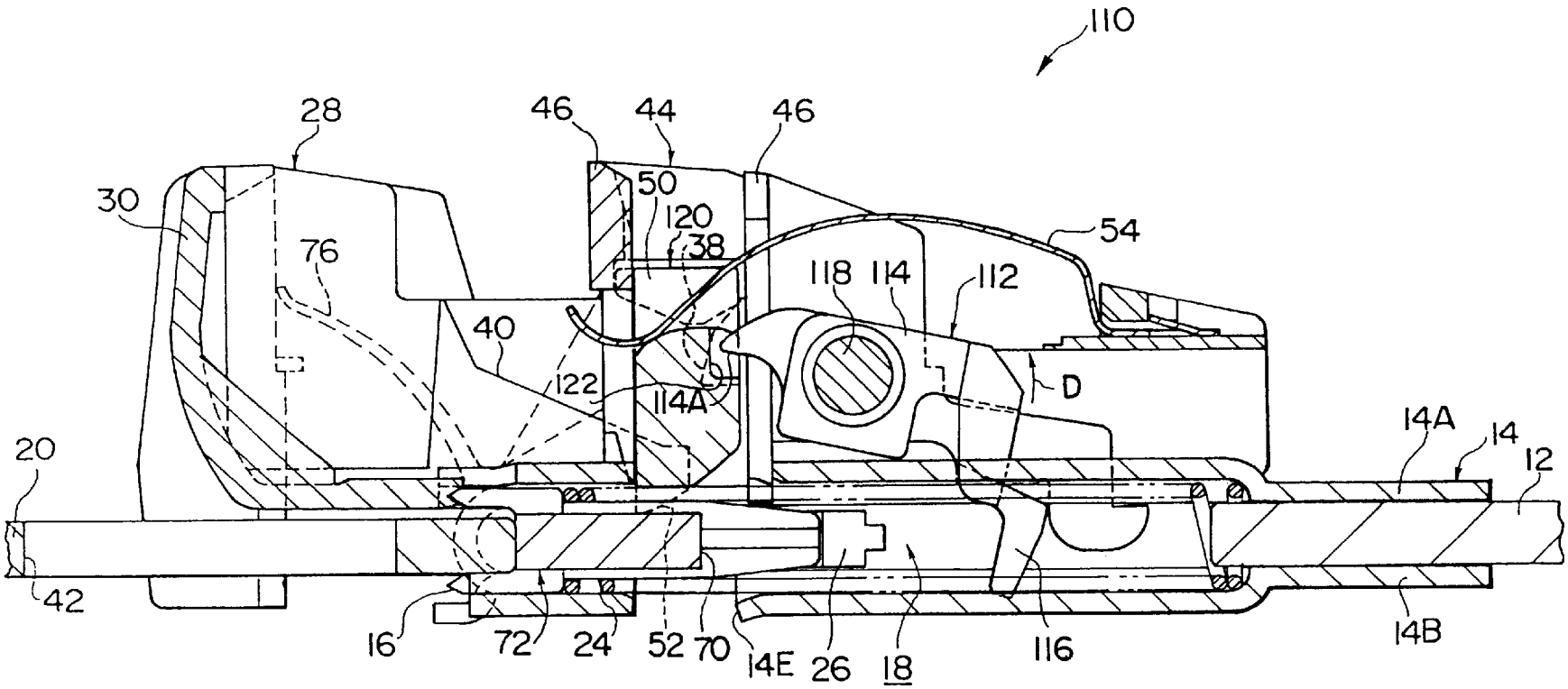
FIG. 5 is a cross-sectional view showing the buckle according to the second embodiment of the present invention.
Figure 6:
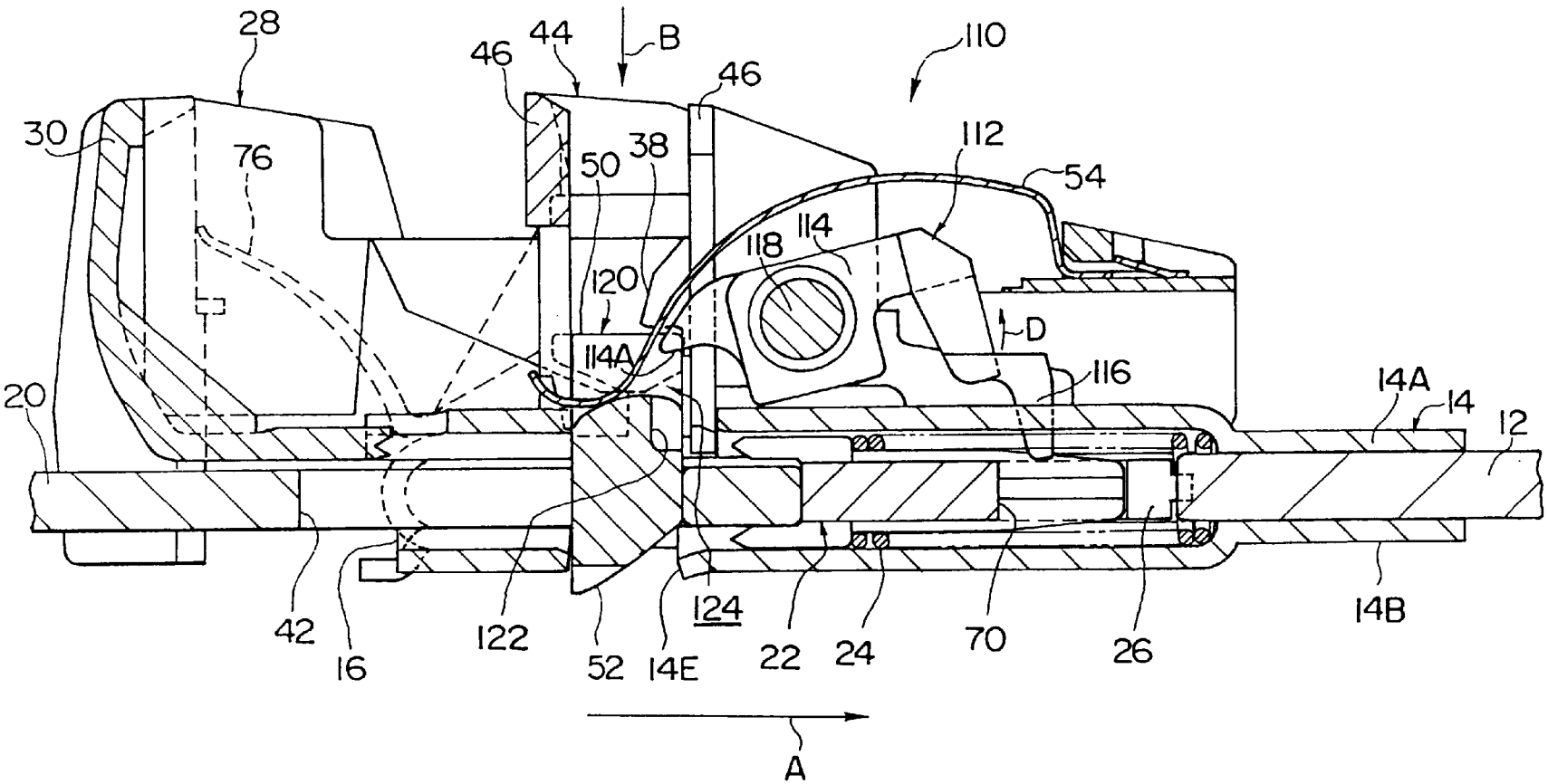
FIG. 6 is a cross-sectional view showing the locked state of the buckle according to the second embodiment of the present invention.

FIGS. 4 to 6 show a buckle 110 according to a second embodiment of the present invention. Hereinafter, the same reference numerals are applied to the same components, members and the like as those of the buckle 10 according to the first embodiment and the descriptions thereof are omitted.

This buckle 110 is not provided with a member which corresponds to the intermediate arm 60 (see FIGS. 1 to 3) of the buckle 10 according to the first embodiment. As an intermediate member that is an alternative to the intermediate arm 60, a swinging lever 112 is provided.

The swinging lever 112 has a swinging portion 114 which is in a substantially T-shaped form in a plan view, and a pair of leg portions 116 which extend from one end of the swinging portion 114. The swinging lever 112 is pivotally supported to the holding block 44 by a pin 118 substantially at the longitudinal directional center of the swinging portion 114, and the swinging lever 112 swings with this pin 118 as the center.

Further, as seen also from FIG. 5, the leg portions 116 extend toward the upper plate 14A of the anchor plate 14 and pass through the elongated holes 14F (see FIG. 4) so that distal ends thereof extend into the insertion portion 18. The distal ends of the leg portions 116 face the distal ends of the protrusions 70 of the horn pieces 26 of the ejector 22. When the tongue plate 20 is inserted into the insertion portion 18 and the ejector 22 is slid in the direction of the arrow A against the urging force of the eject spring 24, the distal ends of the leg portions 66 are pressed by the horn pieces 26, and the swinging lever 112 swings in the counterclockwise direction (the direction of the arrow D) shown in FIG. 5.

The other end of the swinging portion 114 is positioned above a latch 120. Although the latch 120 is formed in substantially the same shape as the latch 48 according to the first embodiment, the latch 120 differs in that a recessed portion 122 corresponding to the other end of the swinging portion 114 is formed at the transverse directional central position of the latch 120. As shown in FIG. 5, in a state in which the tongue plate 20 is not inserted into the insertion portion 18, the other end 114A of the swinging portion 114 is within the recessed portion 122.

Further, the shapes of the swinging portion 114 and the recessed portion 122 are determined such that the other end 114A of the swinging portion 114 is positioned with a predetermined clearance 124 from the recessed portion 122 in the engaged state of the latch 120, as shown in FIG. 6. In this state, the swinging lever 112 can swing within a range from the position (the state) in which the distal ends of the leg portions 116 abut against the distal ends of the protrusions 70 of the ejector 22 to the position (the state) in which the other end 114A of the swinging portion 114 abuts against an inner surface of the recessed portion 122.

Upper surfaces of the protrusions 38 have larger angles of inclination than those of the protrusions 38 according to the first embodiment (see FIGS. 1 to 3), so that, when the latch 120 is moved in the engaging direction (the direction of the arrow B), the upper surfaces of the protrusions 38 are pressed by the lower surfaces of the abutment pieces 50 and the button 28 can be moved in the direction of the arrow A.

Therefore, in the buckle 110 according to the second embodiment which is structured in this manner, when the tongue plate 20 is inserted into the insertion portion 18, the distal ends of the protrusions 70 of the horn pieces 26 of the ejector 22 abut against the distal ends of the leg portions 116 of the swinging lever 112, and thus the swinging lever 112 swings in the counterclockwise direction (the direction of the arrow D) shown in FIG. 5. Due to this swing, the other end 114A of the swinging portion 114 pushes the latch 120 in the engaging direction (the direction of the arrow B), so that the latch 120 is moved in the engaging direction. Further, the protrusions 38 of the button 28 are pushed by the abutment pieces 50 of the latch 120 so that the button 28 is moved in the direction of the arrow A. When the amount of the movement thereof reaches a predetermined value, the other end of the swinging portion 114 is separated from the recessed portion 122 of the latch 120, the protrusions 38 are also separated from the abutment pieces 50 of the latch 120, and the latch 120 is moved further in the engaging direction by the urging force of the lock spring 54. Then, the engagement piece 52 engages with the engagement hole 42 of the tongue plate 20. The button 28 is pushed by the plate spring pieces 76 and is moved in the direction opposite to the arrow A so as to be in the locked state.

In the locked state, the protrusions 38 of the button 28 abut against the abutment pieces 50 of the latch 120 from the upper side thereof so as to prevent the latch 48 from moving in the disengaging direction (the direction opposite to the arrow B).

Further, in the locked state, the predetermined clearance 124 is formed between the swinging lever 112 and the latch 120. Accordingly, even if the tongue plate 20 is pushed further in the direction of the arrow A, the swinging lever 112 only swings via the ejector 22, the latch 120 is not moved in the disengaging direction, and the button 28 is not moved in the unlocking direction (the direction of the arrow A).

In order to release the locked state so as to separate the tongue plate 20 from the buckle 110, in the same manner as the buckle 10 according to the first embodiment, the pressing plate 30 of the button 28 is pressed and the button 28 is slid in the unlocking direction (the direction of the arrow A). The protrusions 38 of the button 28 are thereby separated from the abutment pieces 50 of the latch 120, and the release surfaces 40 of the button 28 push the abutment pieces 50 of the latch 120 in the disengaging direction (the direction opposite to the arrow B), so that the latch 120 is moved in the disengaging direction, and the engagement piece 52 is removed from the engagement hole 42 of the tongue plate 20. As a result, the tongue plate 20 is removed in the direction opposite to the arrow A by the urging force of the eject spring 24 which is applied via the ejector 22.

In this way, in the buckle 110 according to the second embodiment as well, in the locked state, the clearance 124 is formed between the swinging lever 112 and a portion from the tongue plate 20 to the button 28, so that the button 28 is not moved in the unlocking direction even if the tongue plate 20 is moved, and thus, there is no need to form the protrusions 38 in a large size. This facilitates formation of the button 28, and only a small moving stroke of the button 28 is needed for unlocking. Further, as the entire buckle 110 can be formed in a small size as well, the buckle 110 can be manufactured at lower cost.

Figure 7:
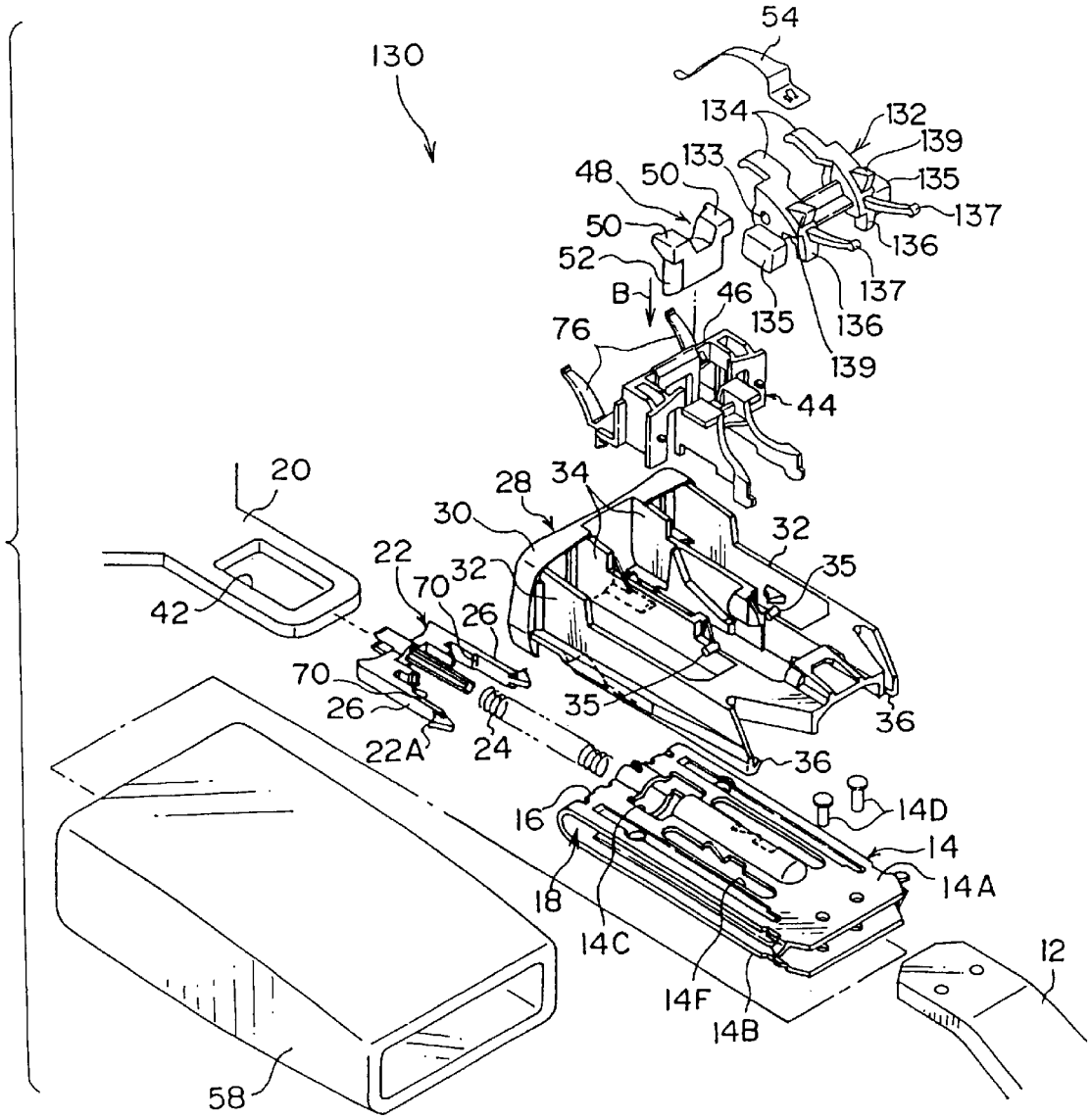
FIG. 7 is an exploded perspective view showing the buckle according to a third embodiment of the present invention.
Figure 8:
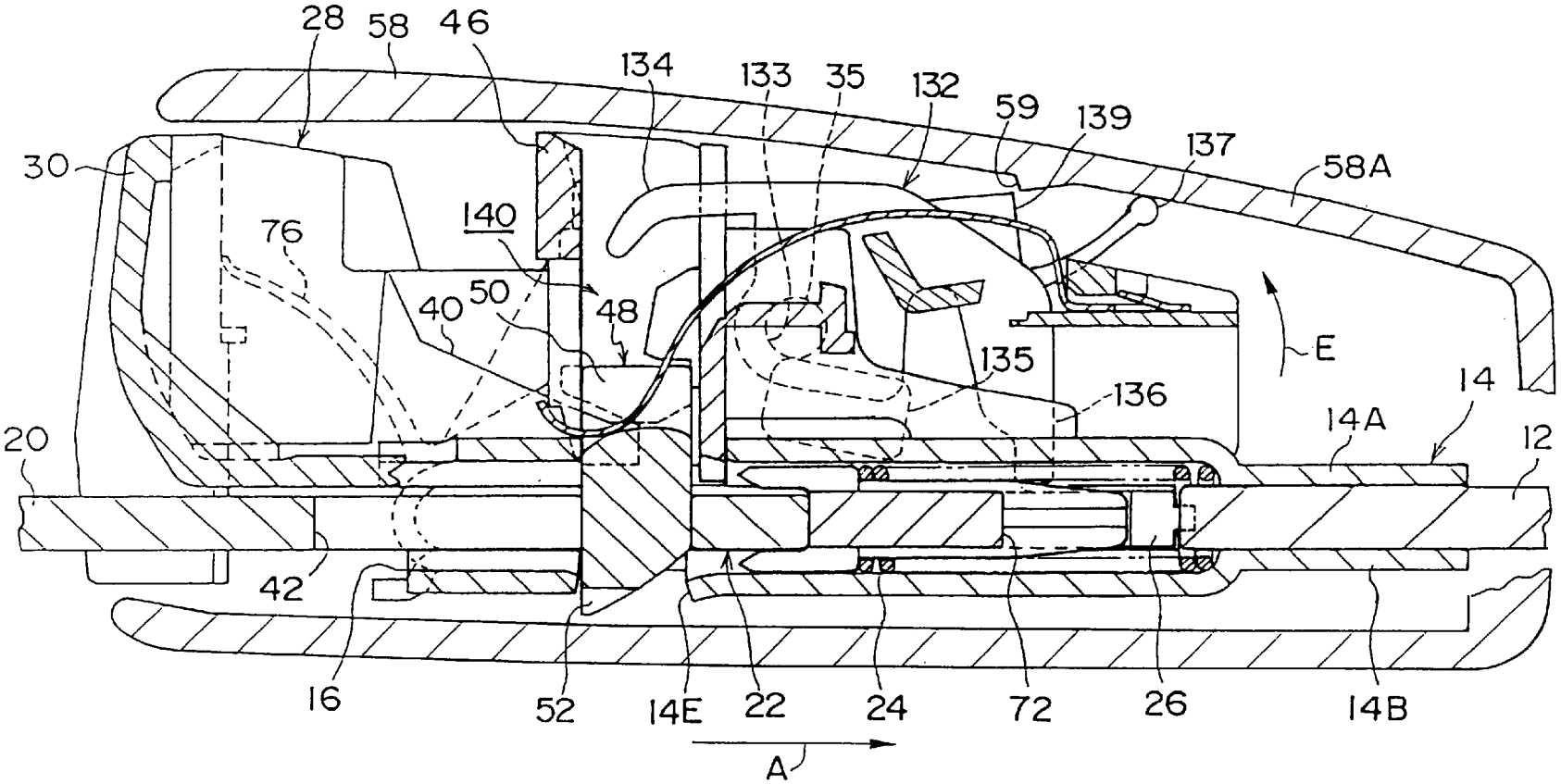
FIG. 8 is a cross-sectional view showing the locked state of the buckle according to the third embodiment of the present invention.
Figure 9:
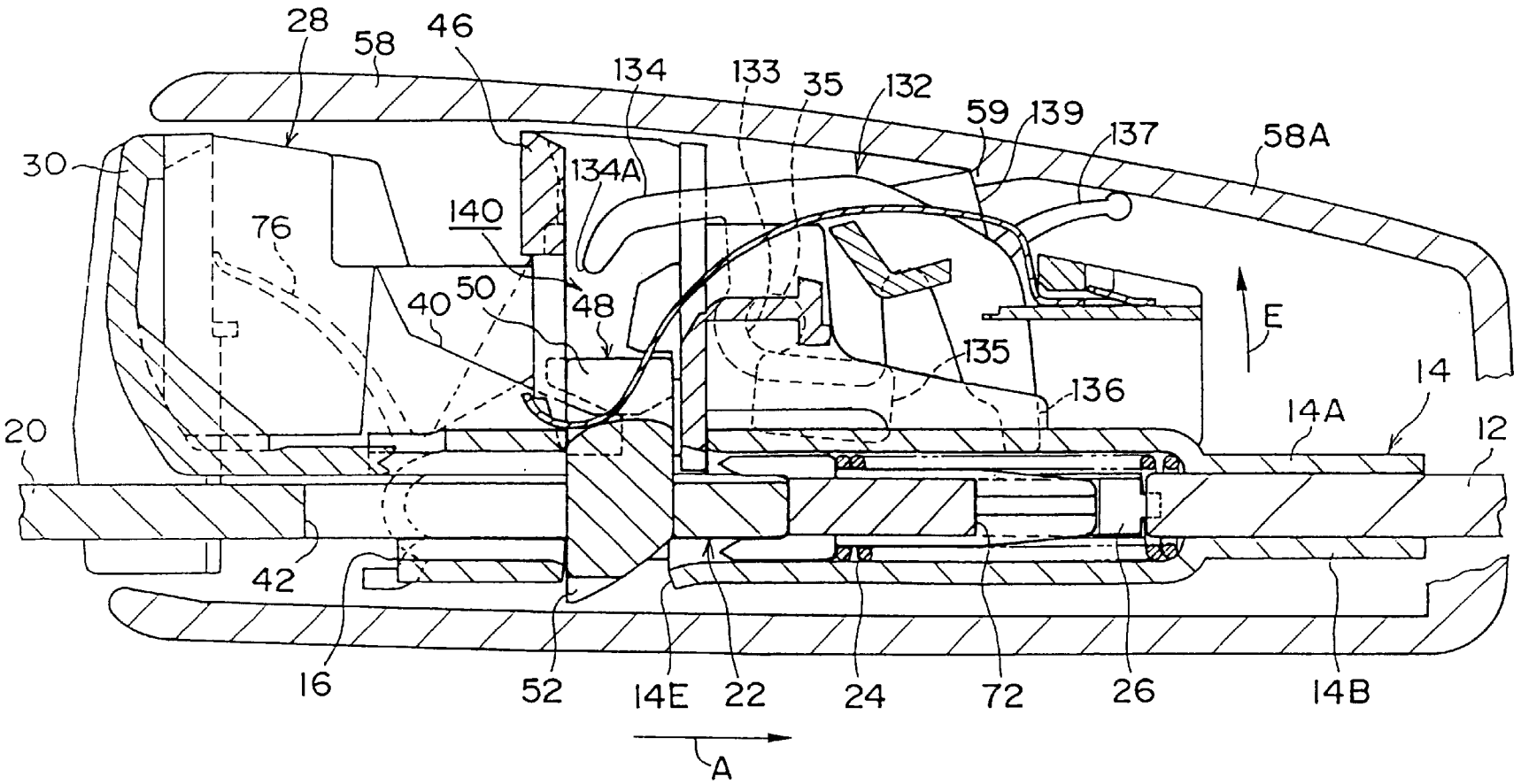
FIG. 9 is a cross-sectional view showing the state in which inertial force is applied in the locked state of the buckle according to the third embodiment of the present invention.
Figure 10:
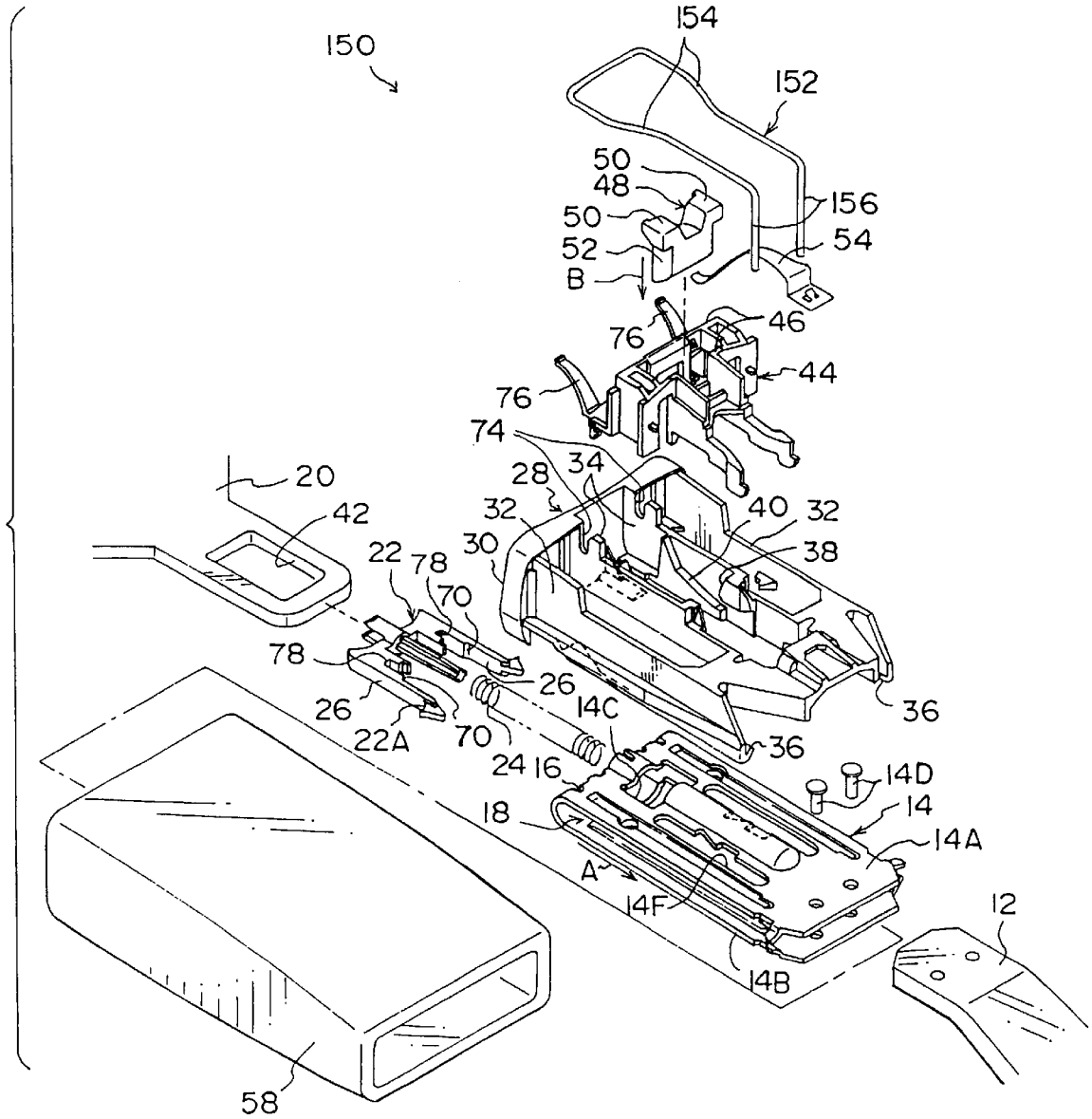
FIG. 10 is an exploded perspective view showing the buckle according to a fourth embodiment of the present invention.
Figure 11:
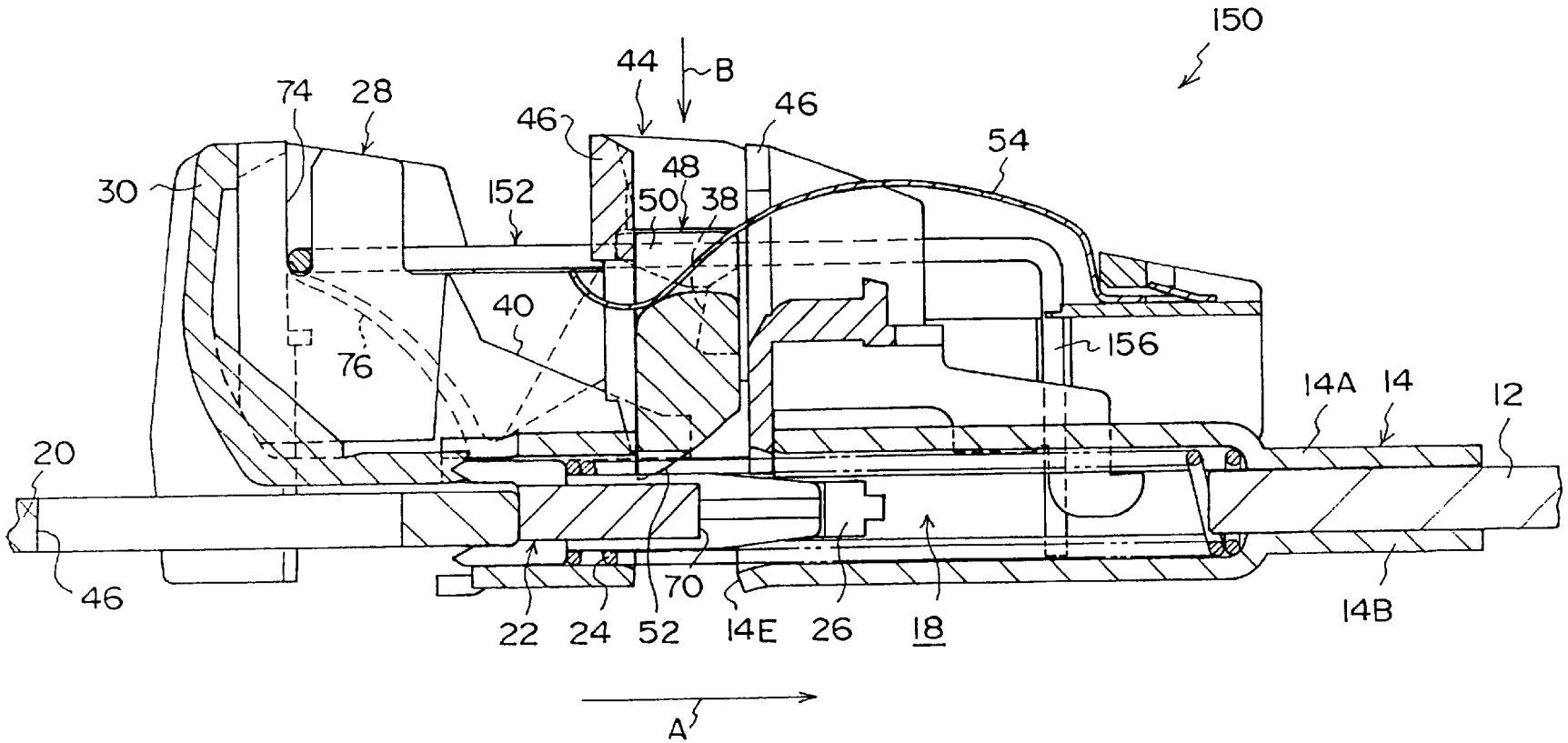
FIG. 11 is a horizontal cross-sectional view showing the buckle according to the fourth embodiment of the present invention.

FIGS. 7 to 9 show a buckle 130 according to a third embodiment of the present invention. Hereinafter, the same reference numerals are applied to the same components, members and the like as those of the buckle 10 according to the first embodiment and descriptions thereof are omitted.

This buckle 130 is not provided with a member which corresponds to the intermediate arm 60 (see FIGS. 1 to 3) of the buckle 10 according to the first embodiment, either. As an intermediate member that is an alternative to the intermediate arm 60, a swinging arm 132 is provided.

The swinging arm 132 is formed with synthetic resin in a substantially U-shaped form in a plan view, and is formed by swinging portions 134 and a pair of leg portions 136 which extend in a horn shape from respective one ends of the swinging portions 134. Axis holes 133 are formed substantially at the longitudinal directional centers of the swinging portions 134, and pins 35 which are formed at the inner plates 34 of the button 28 are inserted into the axis holes 133. The swinging arm 132 swings around these pins 35.

Further, the leg portions 136 extend toward the upper plate 14A of the anchor plate 14 and pass through the elongated holes 14F (see FIG. 1) so that distal ends thereof extend into the insertion portion 18. The distal ends of the leg portions 136 face the distal ends of the protrusions 70 of the horn pieces 26 of the ejector 22. When the tongue plate 20 is inserted into the insertion portion 18 and the ejector 22 is thereby slid in the direction of the arrow A against the urging force of the eject spring 24, the distal ends of the leg portions 66 are pressed by the horn pieces 26, and the swinging arm 132 swings in the counterclockwise direction (the direction of the arrow E) shown in FIG.

The other ends of the swinging portions 134 are positioned above the abutment pieces 50 of the latch 48. In the state in which the tongue plate 20 is not inserted into the insertion portion 18, the other ends of the swinging portions 134 are in contact with the abutment pieces 50. In this state, the protrusions 38 of the button 28 abut against the abutment pieces 50 from the lower direction so as to prevent the latch 48 from moving in the engaging direction (the direction of the arrow B).

Further, the shape of the swinging portions 134 is determined so that the other ends 134A of the swinging portions 134 are positioned with a predetermined clearance 140 from the abutment pieces 50 in the engaged state of the latch 48, as shown in FIG. 9.

A pair of spring pieces 137 are integrally provided so as to protrude from upper portions of the leg portions 136 in the same direction as the unlocking direction of the button 28 (the direction of the arrow A). As shown in FIG. 8, distal ends of the spring pieces 137 are in contact with an upper wall 58A of the cover 58. Although the swinging arm 132 can rotate in the direction of the arrow E and in the opposite direction thereto, when the swinging arm 132 is rotated in the direction of the arrow E, the swinging arm 132 is urged to rotate in the direction opposite to the arrow E by reactive force due to elastic deformation of the spring pieces 137.

Further, the swinging arm 132 is provided with weights 135 having predetermined mass at positions which are closer to the anchor plate 14 than the axis holes 133. As shown in FIG. 9, when inertial force of a predetermined value or more is applied to the buckle 130 in the unlocking direction of the button 28 (the direction of the arrow A), the weights 135 move inertially and rotate the swinging arm 132 in the direction of the arrow E against the urging-rotation force by the spring pieces 137. Although the material and shape of the weights 135 are not limited particularly, when the swinging arm 132 is made of resin as mentioned above, materials having larger specific gravity than that of resin (e.g., metal or the like) may be used.

Engaging pawls 139 having substantially triangularly shaped side surfaces are formed from respective one ends of the swinging portions 134 (end portions of the direction of the arrow A) toward the upper wall 58A of the cover 58. These engaging pawls 139 are formed at predetermined positions so as not to engage with engaging protrusions 59 formed at the upper wall 58A of the cover 58 when the swinging arm 132 is not rotated in the direction of the arrow E, as shown in FIG. 8, and so as to engage with the engaging protrusions 59 when the swinging arm 132 is rotated in the direction of the arrow E, as shown in FIG. 9. When the engaging pawls 139 engage with the engaging protrusions 59 in this manner, the swinging arm 132 is prevented from moving in the direction of the arrow E. Since the swinging arm 132 is attached to the button 28 by the pins 35, the button 28 is also prevented from moving in the unlocking direction (the direction of the arrow A). Although the spring pieces 137 and the engaging pawls 139 do not necessarily need to be provided integrally with the swinging arm 132, the above-mentioned integration can prevent the number of parts from increasing and can decrease the manufacturing cost. In the same manner, although the pins 35 do not necessarily need to be provided integrally with the button 28, the integration can prevent the number of parts from increasing and can decrease the manufacturing cost.

Therefore, in the buckle 130 according to the third embodiment which is structured in this manner, when the tongue plate 20 is inserted into the insertion portion 18, the horn pieces 26 of the ejector 22 abut against the distal ends of the leg portions 136 of the swinging arm 132, and thus the swinging arm 132 swings in the counterclockwise direction (the direction of the arrow E) shown in FIG. 8 against the urging force of the spring pieces 137. The other ends 134A of the swinging portions 134 abut against the upper surfaces of the abutment pieces 50 of the latch 48 so that this swinging is restricted within a fixed range, and thus the engaging pawls 139 do not engage with the engaging protrusions 59. The pressing force is applied from the swinging arm 132 through the pins 35 to the button 28, and the button 28 is slid in the direction of the arrow A. Accordingly, the protrusions 38 of the button 28 are separated from the abutment pieces 50 of the latch 48, and thus, the latch 48 is moved in the engaging direction (the direction of the arrow B) by receiving the urging force of the lock spring 54. The engagement piece 52 of the latch 48 passes through the pass-through hole 14C of the upper plate 14A, and engages with the engagement hole 42 of the tongue plate 20. The button 28 is pushed by the plate spring pieces 76 and is moved in the direction opposite to the arrow A so as to be in the locked state.

In the locked state, the protrusions 38 of the button 28 abut against the abutment pieces 50 of the latch 48 from the upper side thereof so as to prevent the latch 48 from moving in the disengaging direction (the direction opposite to the arrow B).

Further, in the locked state, the swinging arm 132 is urged to rotate in the clockwise direction (the direction opposite to the arrow E) shown in FIG. 8 by the spring pieces 137, and the predetermined clearance 140 is formed between the swinging arm 132 and the latch 48. Accordingly, even if the tongue plate 20 is pushed further in the direction of the arrow A, the swinging arm 132 only swings via the ejector 22; the ejector 22 is not moved in the disengaging direction, and the button 28 is not moved in the unlocking direction (the direction of the arrow A).

For example, when acceleration or deceleration of a predetermined value or more operates on a vehicle in the locked state, inertial force in the unlocking direction (the direction of the arrow A) may be applied to the button 28. At this time, the inertial force is also applied to the weights 135 of the swinging arm 132, and the weights 135 tend to move inertially in the direction of the arrow A. Accordingly, as shown in FIG. 9, the swinging arm 132 rotates in the counterclockwise direction (the direction of the arrow E) against the urging-rotation force of the spring pieces 137, and the engaging pawls 139 engage with the engaging protrusions 59. The swinging arm 132 is prevented from rotating, and the button 28 to which the swinging arm 132 is attached is also prevented from moving in the unlocking direction (the direction of the arrow A).

In this way, even if the inertial force in the unlocking direction is applied to the button 28 in the locked state, the button 28 is prevented from moving in the unlocking direction. Therefore, there is no possibility of the latch 48 being inadvertently moved in the disengaging direction so as to be unlocked, and the latch 48 is certainly maintained in the locked state.

In order to release the locked state so as to separate the tongue plate 20 from the buckle 130, in the same manner as the buckle 10 according to the first embodiment, the pressing plate 30 of the button 28 is pressed and the button 28 is slid in the unlocking direction (the direction of the arrow A). The protrusions 38 of the button 28 are thereby separated from the abutment pieces 50 of the latch 48, and the release surfaces 40 of the button 28 push the abutment pieces 50 of the latch 48 in the disengaging direction (the direction opposite to the arrow B), so that the latch 48 is moved in the disengaging direction, and the engagement piece 52 is removed from the engagement hole 42 of the tongue plate 20. As a result, the tongue plate 20 is removed in the direction opposite to the arrow A by the urging force of the eject spring 24 which is applied via the ejector 22.

In this way, in the buckle 130 according to the third embodiment as well, in the locked state, the clearance 140 is formed between the swinging arm 132 and a portion from the tongue plate 20 to the button 28, so that the button 28 is not moved in the unlocking direction even if the tongue plate 20 is moved, and thus, there is no need to form the protrusions 38 in a large size. This facilitates the formation of the button 28, and only a small moving stroke of the button 28 is needed for unlocking. Further, as the entire buckle 130 can be formed in a small size as well, the buckle 130 can be manufactured at lower cost.

FIGS. 10 to 14 show a buckle 150 according to a fourth embodiment of the present invention. Hereinafter, the same reference numerals are applied to the same components, members and the like as those of the buckle 10 according to the first embodiment and descriptions thereof are omitted.

This buckle 150 is not provided with a member which corresponds to the intermediate arm 60 (see FIG. 1) of the buckle 10 according to the first embodiment, either. As an intermediate member that is an alternative to the intermediate arm 60, an enlargement/reduction link 152 is provided.

The enlargement/reduction link 152 is in a substantially U-shaped form in a plan view, and one end thereof is received in receiving slits 74 formed at the inner plates 34 of the button 28. Thus, the enlargement/reduction link 152 is moved in the direction of the arrow A and in the opposite direction thereto together with the button 28.

Figure 12:
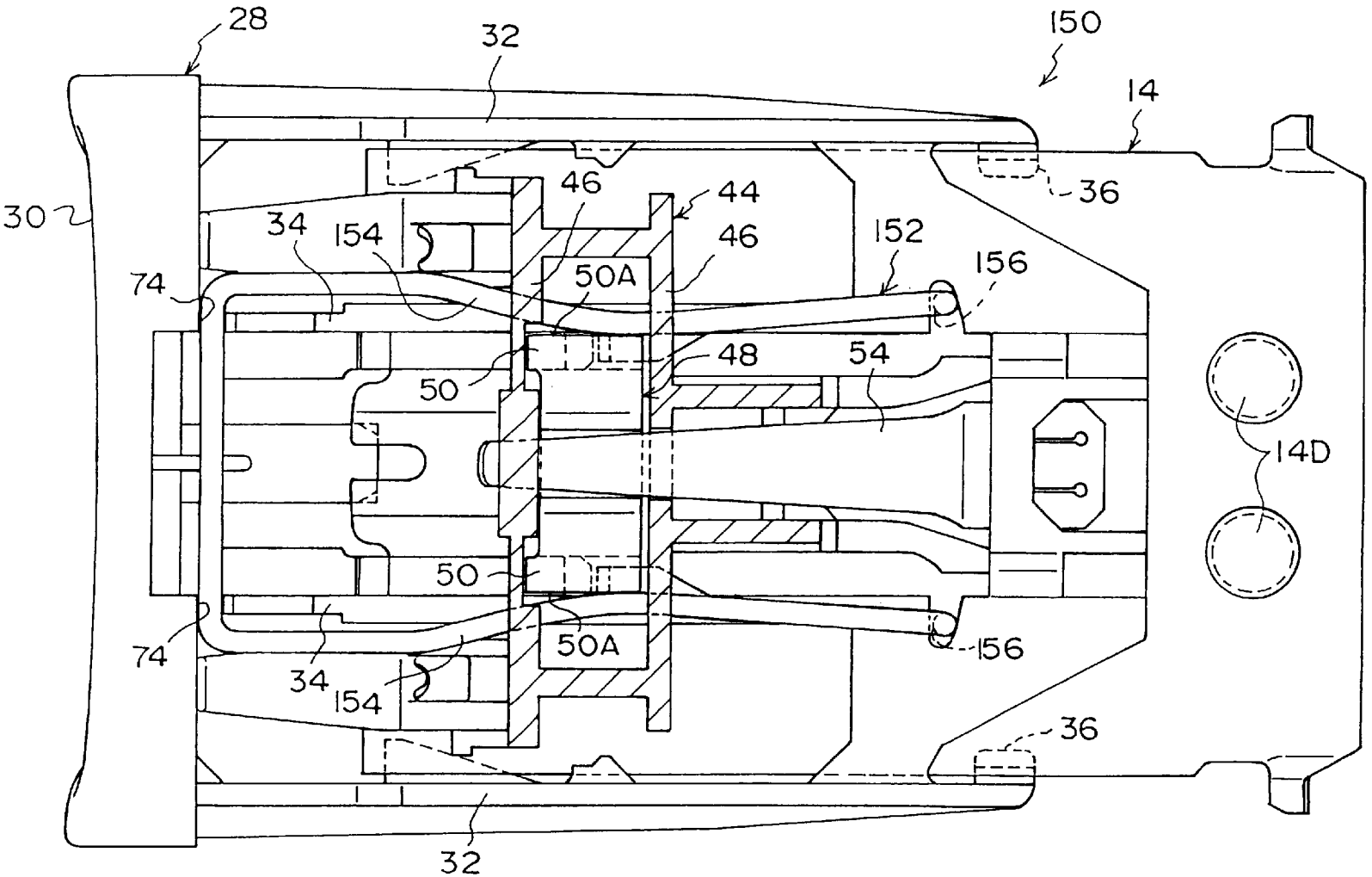
FIG. 12 is a vertical cross-sectional view showing the buckle according to the fourth embodiment of the present invention.
Figure 14:
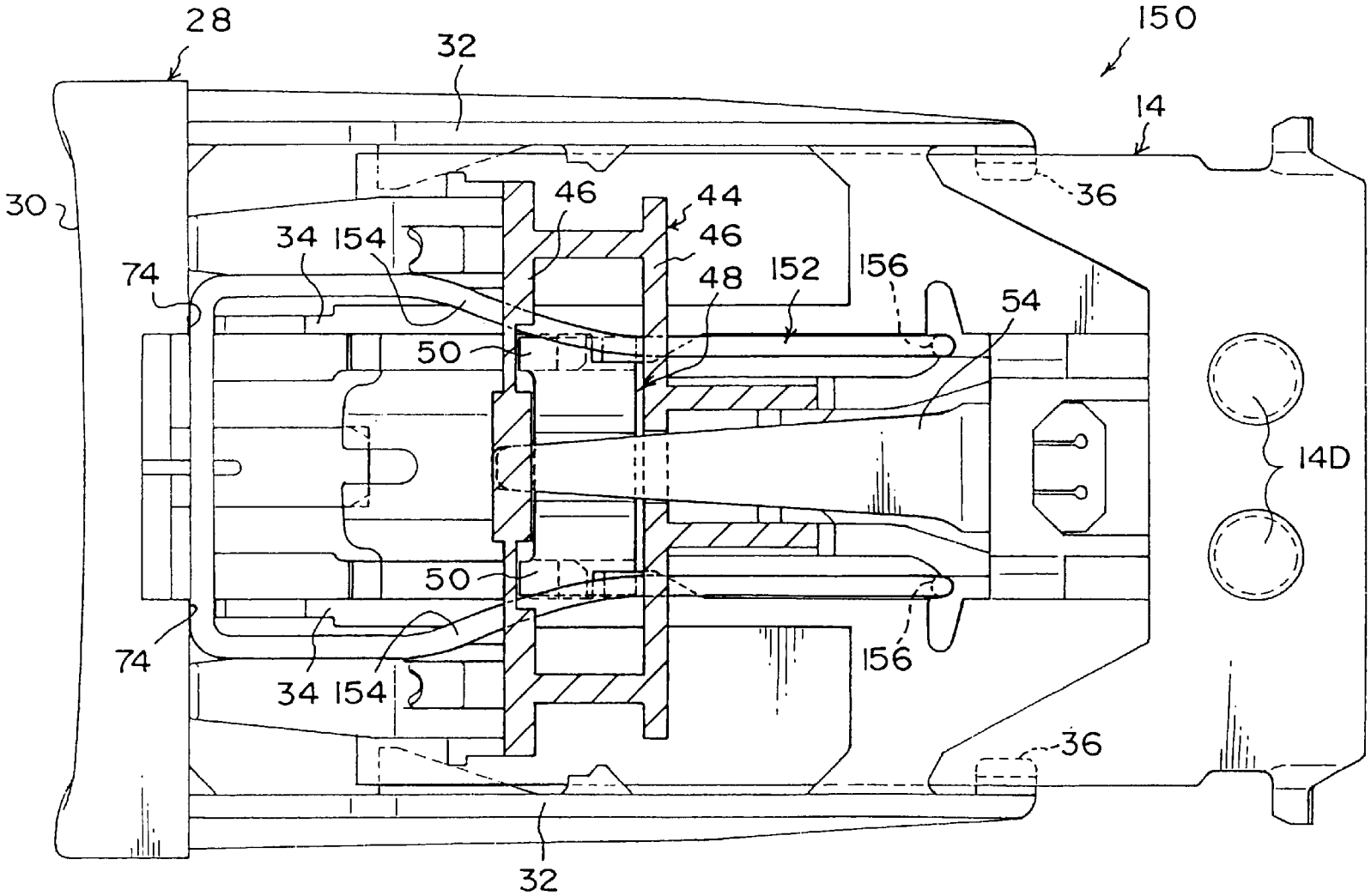
FIG. 14 is a vertical cross-sectional view showing the locked state of the buckle according to the fourth embodiment of the present invention.
Figure 15:
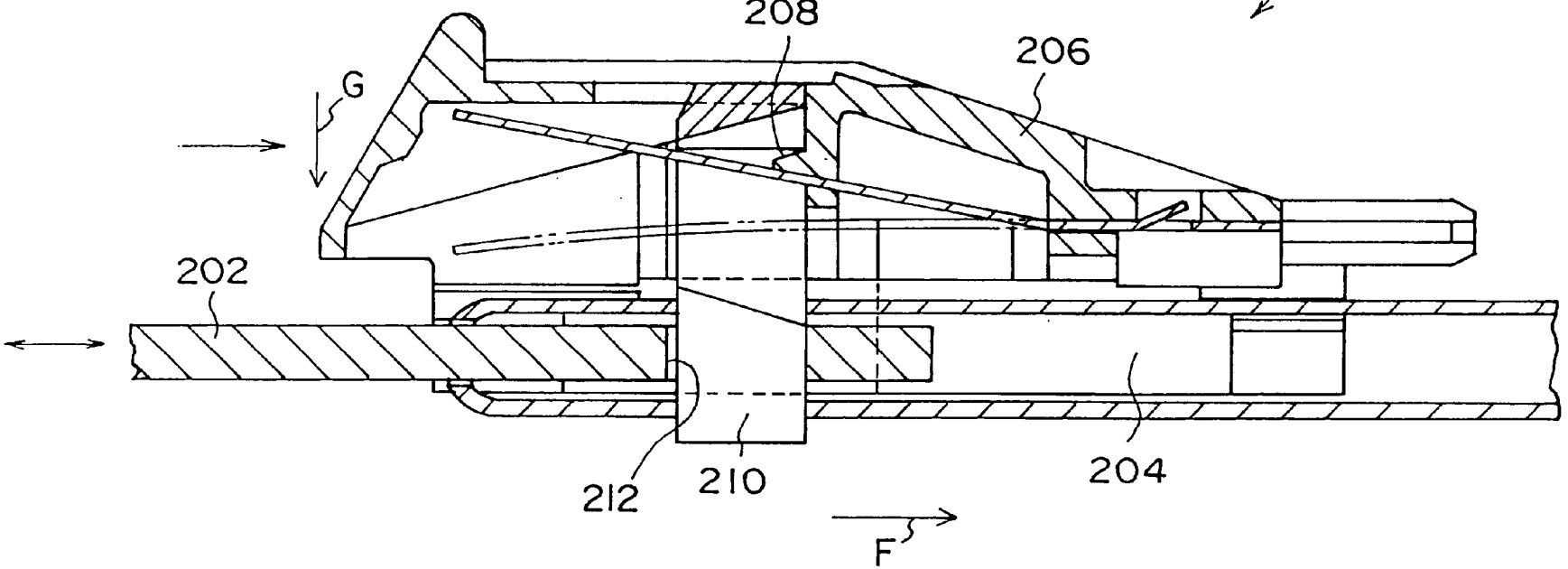
FIG. 15 is a cross-sectional view showing a conventional buckle.

As shown in FIG. 14, taper portions 154, which gradually approach each other from the one end toward the other ends in the natural state, are formed in the enlargement/reduction link 152. These taper portions 154 are positioned above the latch 48, and are formed at predetermined positions so that end surfaces 50A of the abutment pieces 50 of the latch 48 can abut against the enlargement/reduction link 152 from the inner side in order to expand the link 152, in the state in which the latch 48 has not moved in the engaging direction (the direction of the arrow B), as shown in FIG. 12. On the other hand, in the state in which the latch 48 has moved in the engaging direction (the direction of the arrow B), as shown in FIG. 14, the end surfaces 50A of the abutment pieces 50 of the latch 48 are separated from the enlargement/reduction link 152, and thus, the enlargement/reduction link 152 is restored elastically and the taper portions 154 are positioned above the latch 48.

The other ends of the enlargement/reduction link 152 are formed as leg portions 156, which extend toward the upper plate 14A of the anchor plate 14 and pass through the elongated holes 14F (see FIG. 10) so as to extend into the insertion portion 18. In the state in which the other ends of the enlargement/reduction link 152 are expanded (see FIG. 12), distal ends of the leg portions 156 face the distal ends of the protrusions 70 of the horn pieces 26 of the ejector 22.

When the tongue plate 20 is inserted into the insertion portion 18 and the ejector 22 is thereby slid in the direction of the arrow A against the urging force of the eject spring 24, the distal ends of the leg portions 66 are pressed by the horn pieces 26, and the enlargement/reduction link 152 is moved in the direction of the arrow A. Further, when the enlargement/reduction link 152 is restored elastically so as to be in the natural state, the distal ends of the leg portions 156 are separated from the distal ends of the horn pieces 26 of the ejector 22, and face recessed receiving portions 78 formed at inner sides of the horn pieces 26.

Figure 13:
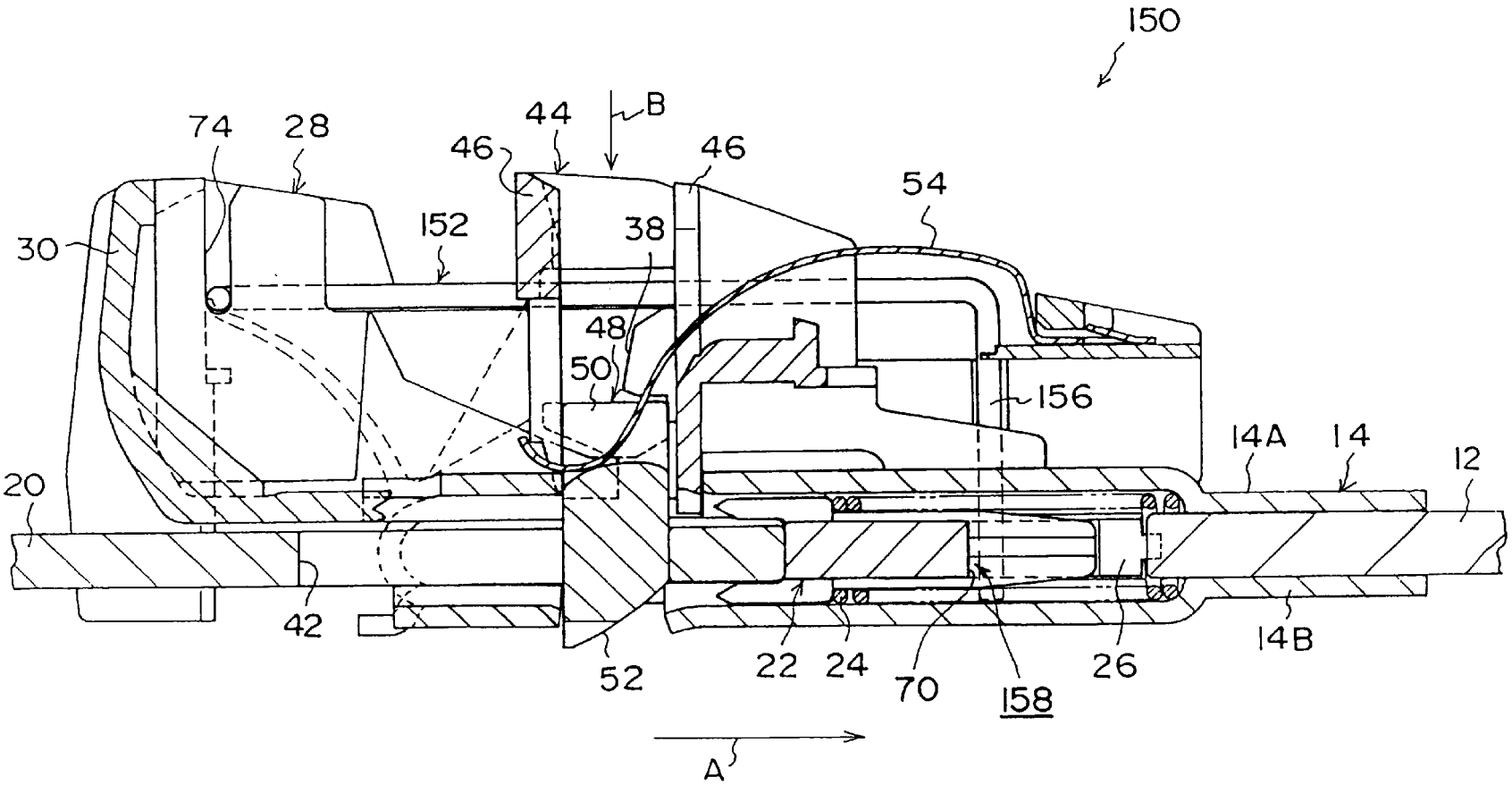
FIG. 13 is a horizontal cross-sectional view showing the locked state of the buckle according to the fourth embodiment of the present invention.

Therefore, in the buckle 150 according to the fourth embodiment which is structured in this manner, as shown in FIG. 13, when the tongue plate 20 is inserted into the insertion portion 18, the distal ends of the protrusions 70 of the horn pieces 26 of the ejector 22 abut against the distal ends of the leg portions 156 of the enlargement/reduction link 152, and thus the enlargement/reduction link 152 is moved in the direction of the arrow A. Accordingly, the button 28 is slid in the direction of the arrow A and the protrusions 38 of the button 28 are separated from the abutment pieces 50 of the latch 48, and thus, the latch 48 is moved in the engaging direction (the direction of the arrow B) by receiving the urging force of the lock spring 54. The engagement piece 52 of the latch 48 passes through the pass-through hole 14C of the upper plate 14A, and engages with the engagement hole 42 of the tongue plate 20. The button 28 is pushed by the plate spring pieces 76 and is moved in the direction opposite to the arrow A so as to be in the locked state.

In the locked state, the protrusions 38 of the button 28 abut against the abutment pieces 50 of the latch 48 from the upper side thereof so as to prevent the latch 48 from moving in the disengaging direction (the direction opposite to the arrow B).

Further, in the locked state, the end surfaces 50A of the abutment pieces 50 of the latch 48 are separated from the taper portions 154 of the enlargement/reduction link 152, and thus, as shown in FIG. 14, the enlargement/reduction link 152 is restored elastically to the natural state. Accordingly, the distal ends of the leg portions 156 are separated from the distal ends of the protrusions 70 of the horn pieces 26 of the ejector 22, and face the recessed receiving portions 78 with a predetermined clearance 158 therebetween. Therefore, even if the tongue plate 20 is pushed further and the ejector 22 is moved in the direction of the arrow A, the distal ends of the leg portions 156 are received in the recessed receiving portions 78 and are not pushed by the ejector 22, and the button 28 is not moved in the unlocking direction (the direction of the arrow A), either.

In order to release the locked state so as to separate the tongue plate 20 from the buckle 150, in the same manner as the buckle 10 according to the first embodiment, the pressing plate 30 of the button 28 is pressed and the button 28 is slid in the unlocking direction (the direction of the arrow A). The protrusions 38 of the button 28 are thereby separated from the abutment pieces 50 of the latch 48, and the release surfaces 40 of the button 28 push the abutment pieces 50 of the latch 48 in the disengaging direction (the direction opposite to the arrow B), so that the latch 48 is moved in the disengaging direction, and the engagement piece 52 is removed from the engagement hole 42 of the tongue plate 20. The tongue plate 20 is removed in the direction opposite to the arrow A by the urging force of the eject spring 24 which is applied via the ejector 22. Further, the taper portions 154 of the enlargement/reduction link 152 are also moved in the direction of the arrow A, and wider portions of the taper portions 154 are positioned above the latch 48. Therefore, when pressing force to the pressing plate 30 is released and the button 28 is moved in the direction opposite to the arrow A, the end surfaces 50A of the abutment pieces 50 of the latch 48 expand the taper portions 154 from the inner side thereof, and the other ends of the leg portions 156 of the enlargement/reduction link 152 are moved to the positions which face the distal ends of the protrusions 70 of the horn pieces 26 of the ejector 22.

In this way, also in the buckle 150 according to the fourth embodiment, in the locked state, the clearances 158 are formed between the enlargement/reduction link 152 and a portion from the tongue plate 20 to the button 28, so that the button 28 is not moved in the unlocking direction even if the tongue plate 20 is moved, and thus, there is no need to form the protrusions 38 in a large size. This facilitates formation of the button 28, and only a small moving stroke of the button 28 is needed for unlocking. Further, as the entire buckle 150 can be formed in a small size as well, the buckle 150 can be manufactured at lower cost.

Needless to say, as long as at least one clearance is formed between an intermediate member and a portion from the tongue plate 20 to the button 28 in the locked state of the tongue plate 20, the present invention is not limited to the above-described structure. In other words, the present invention needs only be structured such that the buckle is provided with the intermediate member so as to form the above-mentioned clearance, and that, due to this clearance, the button 28 is not moved in the unlocking direction even if the tongue plate 20 is pushed in the unlocking direction. Therefore, the clearance may be formed between the tongue plate 20 and the intermediate member (in this case, even if the tongue plate 20 is moved in the unlocking direction, the intermediate member is not moved), or may be formed between the button 28 and the intermediate member (in this case, if the tongue plate 20 is moved in the unlocking direction, the intermediate member is moved, but the button 28 is not moved).

Effects of the Invention

The invention includes generally an engaging member, which can engage with a tongue plate inserted into an insertion portion up to a predetermined position; an operating member, which maintains the engaging member in an engaged state with respect to the tongue plate, and which moves the engaging member in a disengaging direction from the tongue plate by a predetermined operation; and an intermediate member, which forms at least one clearance between the intermediate member and a portion from the tongue plate to the operating member in the engaged state of the engaging member. Accordingly, the manufacturing cost of the buckle can be decreased.

In the invention, the intermediate member is a swinging member, which is swingably attached to a supporting plate supporting the engaging member and the operating member or to the operating member, and which is pushed to the tongue plate so as to swing during the tongue plate is inserted into the insertion portion, and which forms the clearance in the engaged state of the engaging member with respect to the tongue plate. Accordingly, the manufacturing cost of the buckle can be decreased.

In the invention, the buckle includes an urging means which urges the engaging member to the engaged state, and the swinging member is formed integrally with the urging means. Accordingly, the engaged state can be maintained more certainly, the number of parts is not increased, and the manufacturing cost is not increased.

In the invention, the intermediate member is a moving member, which is provided at the operating member, and which moves the operating member by insertion of the tongue plate into the insertion portion and moves in a direction intersecting this moving direction orthogonally so as to form the clearance. Accordingly, the manufacturing cost of the buckle can be decreased.

In the invention, the swinging member is attached to the operating member, and includes a weighting body which moves inertially by inertial force of a predetermined value or more in an unlocking direction applied to the operating member, and an engaging portion which engages with an engaged portion and prevents the swinging member from moving in the unlocking direction when the swinging member swings by inertial movement of the weighting body. Accordingly, even if the inertial force is applied in the unlocking direction of the operating member, the engaging member is prevented from moving inadvertently from the tongue plate in the disengaging direction and a locked state is maintained.

I claim:

1. A buckle comprising:

an engaging member, which can engage with a tongue plate inserted into an insertion portion up to a predetermined position;

an operating member, which maintains the engaging member in an engaged state with respect to the tongue plate, and which moves the engaging member in a disengaging direction from the tongue plate by a predetermined operation; and an intermediate member, which forms at least one clearance between the intermediate member and a portion from the tongue plate to the operating member in the engaged state of the engaging member, wherein the intermediate member is a swinging member, which is swingably attached to a supporting plate supporting the engaging member and the operating member or to the operating member, and which is pushed to the tongue plate so as to swing during the tongue plate is inserted into the insertion portion, and which forms the clearance in the engaged state of the engaging member with respect to the tongue plate.

2. A buckle according to claim 1, wherein the buckle includes an urging means which urges the engaging member to the engaged state, and the swinging member is formed integrally with the urging means.

3. A buckle according to claim 1, wherein the swinging member is attached to the operating member, and includes a weighting body which moves inertially by an inertial force of a predetermined value or more in an unlocking direction applied to the operating member, and an engaging portion which engages with an engaged portion and prevents the swinging member from moving in the unlocking direction when the swinging member swings by an inertial movement of the weighting body.

4. A buckle comprising:

an engaging member, which can engage with a tongue plate inserted into an insertion portion up to a predetermined position;

an operating member, which maintains the engaging member in an engaged state with respect to the tongue plate, and which moves the engaging member in a disengaging direction from the tongue plate by a predetermined operation; and an intermediate member, which forms at least one clearance between the intermediate member and a portion from the tongue plate to the operating member in the engaged state of the engaging member, wherein the intermediate member is a moving member, which is provided at the operating member, and which moves the operating member by insertion of the tongue plate into the insertion portion and moves in a direction orthogonal to an intersecting direction of the tongue plate so as to form the clearance.

5. A buckle comprising:

an engaging member, which can engage with a tongue plate inserted into an insertion portion up to a predetermined position;

an operating member, which maintains the engaging member in an engaged state with respect to the tongue plate, and which moves the engaging member in a disengaging direction from the tongue plate by a predetermined operation; and an intermediate member, which forms at least one clearance between the intermediate member and a portion from the tongue plate to the operating member in the engaged state of the engaging member, wherein the buckle further comprises a moving member which moves on the basis of a movement of the tongue plate, and the intermediate member forms a predetermined clearance between the intermediate member and one of the moving member or the engaging member in the engaged state of the engaging member.

6. A buckle comprising:

an engaging member, which can engage with a tongue plate inserted into an insertion portion up to a predetermined position;

an operating member, which maintains the engaging member in an engaged state with respect to the tongue plate, and which moves the engaging member in a disengaging direction from the tongue plate by a predetermined operation;

a movable intermediate member, which forms at least one clearance between the intermediate member and a portion from the tongue plate to the operating member in the engaged state of the engaging member; and an urging member operatively connected to said intermediate member which urges the engaging member to the engaged state.

* * * * *